United States Patent [19]

Hinata et al.

[11] 4,172,730

[45] Oct. 30, 1979

[54] RADIOGRAPHIC SILVER HALIDE SENSITIVE MATERIALS

[75] Inventors: Masanao Hinata; Haruo Takei; Nobuaki Miyasaka; Kenji Takahashi, all of Minami-ashigara, Japan

[73] Assignee: Fuji Photo Film Co., Ltd., Minami-ashigara, Japan

[21] Appl. No.: 787,725

[22] Filed: Apr. 15, 1977

Related U.S. Application Data

[63] Continuation-in-part of Ser. No. 668,003, Mar. 18, 1976, abandoned.

[30] Foreign Application Priority Data

Mar. 18, 1975 [JP] Japan ..... 50-32789

[51] Int. Cl.[2] ..... G03C 1/92

[52] U.S. Cl. ..... 96/82; 96/124

[58] Field of Search ..... 96/82, 124

[56] References Cited

U.S. PATENT DOCUMENTS

| | | | |
|---|---|---|---|
| 3,832,189 | 8/1974 | Shiba et al. | 96/124 |
| 3,854,955 | 12/1974 | Shiba et al. | 96/124 |
| 3,864,134 | 2/1975 | Veda et al. | 96/124 |
| 3,912,933 | 10/1975 | Van Stappen | 96/82 |
| 3,923,515 | 12/1975 | Van Stappen | 96/82 |
| 3,953,215 | 4/1976 | Hinata et al. | 96/82 |

*Primary Examiner*—Travis Brown

*Attorney, Agent, or Firm*—Sughrue, Rothwell, Mion, Zinn and Macpeak

[57] ABSTRACT

Silver halide radiographic sensitive materials comprising at least one silver halide photographic emulsion layer on a support, which are used according to a process which comprises exposure to radiation from a fluorescent intensifying screen which emits light having a maximum emission in the green spectral range by excitation with radiation wherein at least ½ of the emission energy is in the wavelength range of above about 400 nm, and carrying out development of the exposed sensitive material to form radiographic images, wherein said silver halide sensitive materials contain below about 8.6 g of silver per square meter and said at least one silver halide photographic emulsion layer contains a combination of at least one dye represented by formula (I) and at least one dye represented by formula (II):

(I)

(II)

wherein $A_1$ and $A_2$ each represents a hydrogen atom or a halogen atom; $A_3$ and $A_4$ each represents a hydrogen atom, a halogen atom, an alkoxy group or a phenyl group; $B_1$, $B_2$, $B_3$ and $B_4$ each represents a hydrogen atom, a halogen atom or an alkoxy group; R, $R_1$ and $R_2$ each represents an alkyl group and at least one of $R_1$ and $R_2$ represents a sulfoalkyl group or a carboxyalkyl group; $R_0$ represents a hydrogen atom or a lower alkyl group, $R_3$ and $R_4$ each has the same meaning as $R_1$ and $R_2$; $X_1$ represents an anion; m and n each represents an integer of 1 or 2, but m and n are 1 when the dye forms an inner salt; and $X_2$ represents an anion.

1 Claim, 2 Drawing Figures

RADIOGRAPHIC SILVER HALIDE SENSITIVE MATERIALS

CROSS-REFERENCE TO RELATED APPLICATION

This application is a continuation-in-part of U.S. application Ser. No. 668,003, filed Mar. 18, 1976, now abandoned, in the names of Masanao Hinata et al and entitled "Radiographic Silver Halide Sensitive Materials".

BACKGROUND OF THE INVENTION

1. Field of the Invention

The present invention relates to a green sensitized photographic silver halide sensitive materials which are exposed to radiation by contact with an intensifying screen comprising a fluorescent substance which emits light in the green spectral range.

2. Description of the Prior Art

An intensifying paper or a fluorescent plate together with a conventional silver halide photographic film is often used in carrying out X-ray recording in order to enhance the recording sensitivity to X-rays. Enhancing the recording sensitivity to X-rays to obtain effective radiographic images with less doses of X-rays in highly desirable since excess exposure to X-rays is harmful to the human body. Recording fluorescent images on a silver halide photosensitive material using the above procedure is one of the most effective methods to accomplish this purpose.

As fluorescent substances hitherto used for such purposes, there are those which emit blue fluorescent light, such as barium sulfate activated with strontium, barium sulfate activated with lead, barium sulfate activated with silver, calcium tungstate ($CaWO_4$) activated with lead, zinc sulfide activated with silver and barium phosphate ($Ba_3(PO_4)_2$) activated by europium, etc. For purposes of medical treatment, a fluorescent intensifying screen used together with a silver halide radiographic material contains, in fact, calcium tungstate or barium sulfate activated with lead as a fluorescent substance. Recently, studies on intensifying fluorescent screens having a high emission energy intensity have been performed because of increases of requirements on X-ray photography for medical treatment. Particularly, it is known from reports of the Lockheed Aircraft Corp. that rare earth oxysulfide and oxyhalide fluorescent substances activated by another rare earth element have a high emission energy intensity.

Phosphorescent or fluorescent substances used for the fluorescent screen which emits visible light used in the present invention preferably include elements of an atomic number of 39 or from 57 to 71 (for example, yttrium, gadolinium, lanthanum or cerium, etc.). Particularly preferred substances are rare earth oxysulfide and oxyhalide fluoroscent substances activated by another rare earth element, such as lanthanum or gadolinium oxybromide or oxychloride activated by terbium or dysprosium, or lanthanum or gadolinium oxysulfide activated by terbium, europium or a mixture of terbium and samarium, etc. Such rare earth fluorescent substances are described in German Pat. No. 1,282,819, French Pat. Nos. 1,540,341, 1,580,544 and 2,021,397, French Patent of Addition No. 94,579 (Patent of Addition of Basic French Pat. No. 1,473,531), U.S. Pat. Nos. 3,546,128, 3,418,246 and 3,418,247, British Pat. No. 1,414,456, "Rare Earth Oxysulfide X-ray Phosphors" reported by K. A. Wickersheim in IEEE Nuclear Science Symposium in San Francisco on Oct. 29-31, 1969, and "IEEE Transactions on Nuclear Science" pages 81-83, February 1972, written by R. A. Buchanan. Such rare earth fluorescent substances, and particularly gadolinium and lanthanum oxysulfide and oxyhalide activated by erbium, terbium or dysprosium, have a high X-ray stopping power or average absorption capacity and a high emission density and enable radiologists to use substantially lower X-ray dosage levels.

Specific fluorescent substances which are very suitable for use in the intensifying screens employed in the present invention, and which we cite merely as examples, are fluorescent substances having the following general formula:

$$M(p-q)M'_qO_pX$$

wherein M is at least one of the metals yttrium, lanthanum, gadolinium or lutetium, M' is at least one of the metals dysprosium, erbium, europium, holmium, neodymium, praseodymium, samarium, terbium, thulium or ytterbium, X is sulphur or halogen, q is 0.0002 to 0.02 and p is 1 when X is halogen or is 2 when X is sulphur.

It is economically advantageous that the amount of silver halide per unit area of the photosensitive material be small to shorten the period of time for processing, particularly for fixing. However, if a photosensitive material having a low silver halide content is used, the maximum density and contrast of the resultant images become comparatively low. Although an emulsion composed of fine particles is effective for obtaining a high maximum density, it is necessary to use high exposure amounts, because photographic sensitivity is low. Accordingly, it is preferred to use an emulsion which is composed of high sensitivity silver halide particles, whereby sufficiently high maximum density and high contrast can be obtained even if the amount of silver halide per unit area is low.

According to the present invention, preferred results are obtained even if a photographic material containing silver in an amount below about 8.6 g, preferably in an amount of from about 2 to below 8.6 g, per square meter is used. When a silver halide photographic material having silver halide layers on both faces of the support through which fluorescent rays pass is brought into contact with a fluorescent intensifying screen during X-ray exposure, a so-called "cross-over" phenomenon occurs. Light emitted from such a fluorescent screen not only forms black images on the silver halide emulsion layer adjacent the fluorescent screen but also forms blurred images on the silver halide emulsion layer placed on the reverse side of the support because a considerable amount of light passes through the support having a relatively high thickness. This phenomenon is called "cross-over". The degree of cross-over substantially controls the quality of the images formed in the photographic material.

In conventional radiographic recording materials containing a relatively large amount of silver halide per unit area, cross-over occurs to a lesser degree. However, silver halide photosensitive materials having a low silver halide content per unit area are highly affected by cross-over.

The method is known, for example, from Japanese Patent Application (OPI) No. 63,424/74 which comprises incorporating dyes which absorb light having the same wavelength range as that emitted by a fluorescent intensifying screen in at least one layer of a silver halide photographic material in order to reduce cross-over. The dyes used for such purpose are those used usually for inhibiting irradiation (scattering of light in emulsion layers), which usually cause desensitization when present in a silver halide emulsion layer. In fact, some degree of desensitization is inevitable because of the light absorption effect even if dyes which do not chemically cause desensitization are used. On the other hand, these dyes may be added to hydrophilic colloid layers other than a silver halide emulsion layer. However, they inevitably bring about some degree of desensitization because they migrate into the silver halide emulsion layers by diffusion as they are water soluble.

On the other hand, it is possible to dye the base support itself in order to reduce cross-over. However, a sufficient reduction of cross-over is not obtained by dyeing only the base support.

Further, it is preferred that X-ray sensitive materials (direct X-ray sensitive materials and indirect X-ray sensitive materials) be easily processed, for example, at development or fixing, particularly, in a light room. Such X-ray photographic materials have been processed under a safe light using, for example, a No. 7 safe light filter produced by Fuji Photo Film Co., Ltd. The spectral transmission curve of a No. 7 safe light filter is shown in FIG. 1. It is preferred that radiographic materials prepared using silver halide photographic emulsions have a high sensitivity to light emitted by the excitation of the above described improved green fluorescent substances and have a low sensitivity to safe light.

U.S. Pat. No. 3,953,215 Hinata et al is directed to silver halide materials supersensitized to the green region of the spectrum using a combination of cyanine dyes. Supersensitizing dye combinations for the green region of the spectrum are set forth in U.S. Pat. Nos. 3,832,189 and 3,854,955 to Shiba et al or in U.S. Pat. No. 3,864,134 to Ueda et al. U.S. Pat. Nos. 3,912,933 and 3,923,515 to Van Stappen show the use of a pair of intensifying screens in radiographic methods where silver halide is employed.

SUMMARY OF THE INVENTION

One object of the present invention is to provide silver halide sensitive materials for radiography (particularly, medical X-ray photography) which have a high sensitivity to light emitted from an X-ray fluorescent intensifying screen, the maximum emission spectrum of which is in the green spectral range, low sensitivity to a safe light and less susceptibility to cross-over.

Another object of the present invention is to provide a process for obtaining radiographic images of high sharpness using low amounts of radiation exposure, which comprises combining an X-ray fluorescent intensifying screen which emits fluorescence and having its maximum emission in the green spectral range, preferably in the wavelength range 530 to 560 nm, upon X-ray excitation, wherein above one half of the emission energy is in the wavelength range of about about 400 nm with a green sensitized radiographic material having high sensitivity to the above described emission range.

The inventors have found that the above described objects of the invention can be attained by using a combination of specified sensitizing dyes as described in the following.

Namely, the objects of the present invention are attained by incorporating a combination of at least one sensitizing dye represented by the following formula (I) and at least one sensitizing dye represented by the following formula (II) in a silver halide photographic emulsion.

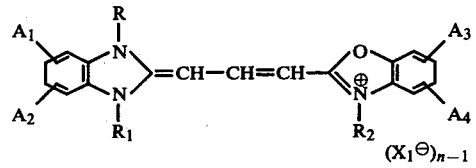

(I)

In formula (I), $A_3$ and $A_4$ can represent the atoms or groups set out below wherein for $A_3$ and $A_4$ any alkoxy moiety preferably has 1 to 6 carbon atoms, more preferably 1 to 4 carbon atoms.

$A_1$ and $A_2$ can each represent a hydrogen atom or a halogen atom (for example, a chlorine atom, bromine atom, fluorine atom or iodine atom), $A_3$ and $A_4$ can each represent a hydrogen atom, a halogen atom (for example, a chlorine atom, bromine atom, fluorine atom or iodine atom), an alkoxy group, preferably lower alkoxy containing 1 to 4 carbon atoms (for example, a methoxy group or ethoxy group, etc.), a phenyl group, including a substituted phenyl group (for example, a phenyl group, a p-sulfophenyl group, etc.). R, $R_1$ and $R_2$ each represents an alkyl group (including substituted alkyl) having from 1 to 18 carbon atoms, preferably a lower alkyl group having from 1 to 4 carbon atoms (e.g., methyl, ethyl, n-propyl, isopropyl, butyl); a vinyl methyl group; a hydroxyalkyl group, preferably hydroxy lower alkyl containing 1 to 4 carbon atoms in the alkyl moiety (e.g., 2-hydroxyethyl-4-hydroxybutyl); an acetoxyalkyl group, preferably acetoxy lower alkyl containing 1 to 4 carbon atoms in the alkyl moiety (e.g., 2-acetoxyethyl, 3-acetoxypropyl); an alkoxyalkyl group, preferably lower alkoxy lower alkyl containing from 1 to 4 carbon atoms in both the alkoxy and alkyl moieties (e.g., 2-methoxyethyl, 3-methoxypropyl, 4-propoxybutyl); a carboxyalkyl group, preferably carboxy lower alkyl containing from 1 to 4 carbon atoms in the alkyl moiety (e.g., 2-carboxyethyl, 3-carboxypropyl, 4-carboxybutyl, 2-(2-carboxyethoxy)ethyl, p-carboxybenzyl); a sulfoalkyl group, preferably sulfo lower alkyl containing from 1 to 4 carbon atoms in the alkyl moiety (e.g., 2-sulfoethyl, 3-sulfopropyl, 3-sulfobutyl, 4-sulfobutyl, 2-hydroxy-3-sulfopropyl, 2-(3-sulfopropoxy) ethyl, 2-acetoxy-3-sulfopropyl, 3-methoxy-2-(3-sulfopropoxy)propyl, 2-[2-(3-sulfopropoxy)ethoxy]ethyl, 2-hydroxy-3-(3'-sulfopropoxy)propyl, p-sulfophenethyl, p-sulfobenzyl); an aralkyl group, preferably an aryl lower alkyl group containing from 1 to 4 carbon atoms in the alkyl moiety (e.g., benzyl, 2-phenethyl, 3-phenbutyl). At least one of $R_1$ and $R_2$ must be a sulfoalkyl group or a carboxyalkyl group.

$X_1$ represents an anion (for example, a chlorine ion, bromine ion, iodine ion, thiocyanate ion, sulfate ion, perchlorate ion, p-toluenesulfonate ion, methyl sulfate ion or ethyl sulfate ion, etc.).

n represents an integer of 1 or 2, and n−1 when the dye forms an inner salt.

The oxacarbocyanine dyes in the present invention are represented by formula (II):

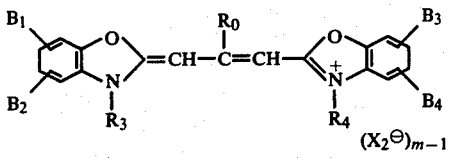

(II)

In formula (II), $B_1$, $B_2$, $B_3$ and $B_4$ each represents a hydrogen atom, a halogen atom (for example, a chlorine atom, bromine atom, fluorine atom or iodine atom), or an alkoxy group, preferably lower alkoxy containing 1 to 4 carbon atoms (for example, a methoxy group or ethoxy group, etc.). $R_0$ represents a hydrogen atom or a lower alkyl group containing from 1 to 4 carbon atoms (for example, a methyl group or ethyl group, etc.). $R_3$ and $R_4$ each has the same meaning as $R_1$ and $R_2$. $X_2$ has the same meaning as $X_1$. m has the same meaning as n.

DETAILED DESCRIPTION OF PREFERRED EMBODIMENTS

Figure 1:
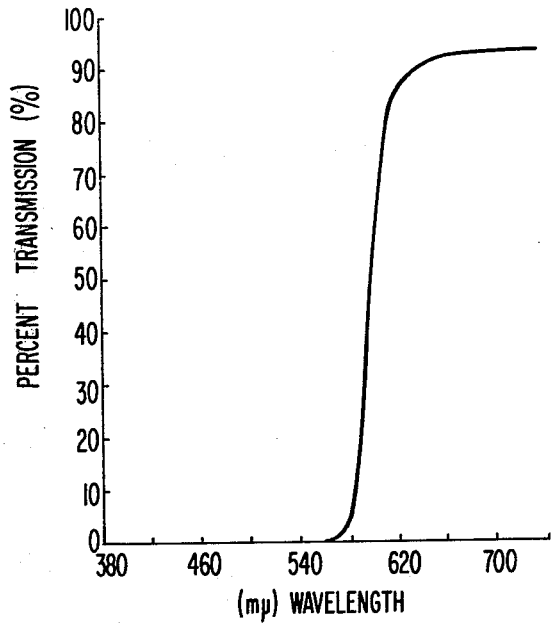
FIG. 1 shows the spectral transmission curve of a safe light filter usually used for processing X-ray photographic films.

Typical examples of benzoimidazolo-oxacarbocyanine dyes used in the present invention include the following compounds. However, the sensitizing dyes used in the present invention are not limited to these compounds.

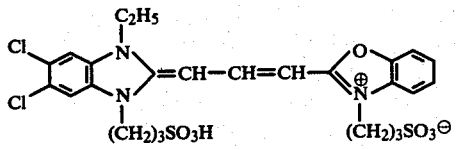

I-1

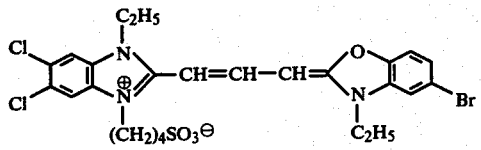

I-2

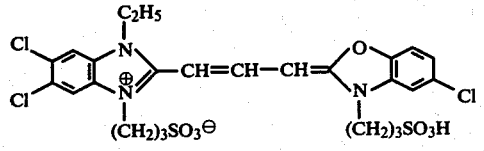

I-3

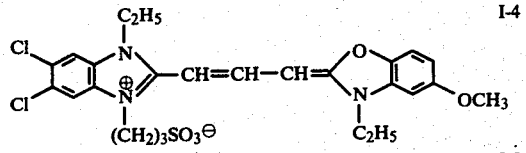

I-4

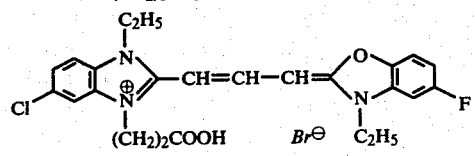

I-5

-continued

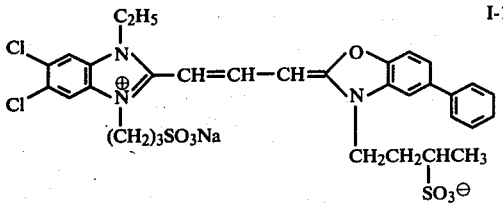

I-10

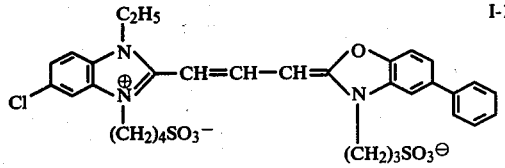

I-17

Typical examples of oxacarbocyanine dyes used in the present invention include the following compounds. However, the sensitizing dyes used in the present invention are not limited to these compounds.

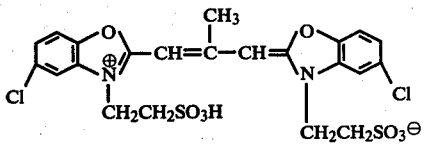

II-1

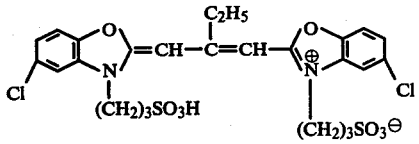

II-2

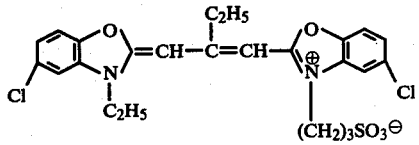

II-3

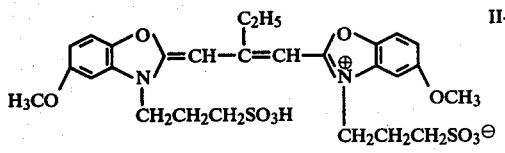

II-4

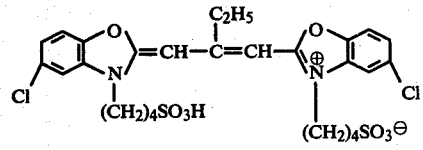

II-6

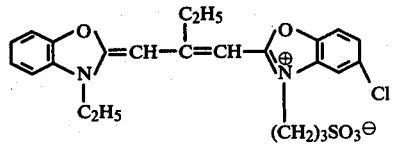

II-7

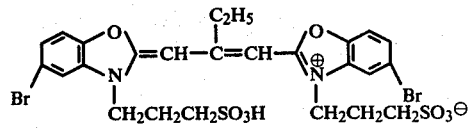

II-8

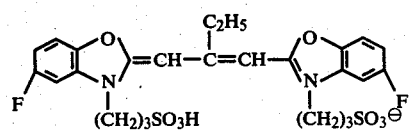

II-12

-continued

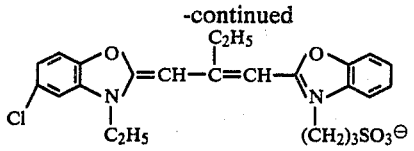

II-13

The dyes represented by formula (I) are sensitizing dyes described, for example, in Japanese Patent Publication No. 14,030/69 and Japanese Patent Application (OPI) No. 33,626/72. They can easily be synthesized by one skilled in the art with reference to the above described patent specifications or by similar processes.

The dyes represented by formula (II) are sensitizing dyes described, for example, in U.S. Pat. No. 3,397,060, British Pat. No. 840,223 and French Pat. No. 2,182,329, etc., which can easily be synthesized by one skilled in the art with reference to the above described patent specifications or by similar processes.

A characteristic of the present invention is that photographic sensitive materials comprising a green sensitized silver halide emulsion layer which is sensitized by a combination of sensitizing dyes represented by formula (I) and sensitizing dyes represented by formula (II) causes less cross-over.

Such cross-over depends highly upon the ratio of the amount of the sensitizing dyes represented by formula (I) to the amount of the sensitizing dyes represented by formula (II). When the molar ratio of (sensitizing dyes represented by formula (II)/sensitizing dyes represented by formula (I)) is about 4 or more, the degree of cross-over is particularly low. In the case of being green sensitized by only sensitizing dyes represented by formula (I), the degree of cross-over is comparatively high as described in the following Examples. However, the degree of cross-over becomes low if the sensitizing dyes represented by formula (II) are used together with the sensitizing dyes represented by formula (I).

Although known anti-irradiation dyes are useful for reducing the degree of cross-over, they have the defect of decreasing the sensitivity to light in the same wavelength range as that absorbed by the dyes. However, if the sensitizing dyes represented by formula (II) are added to a silver halide emulsion together with the sensitizing dyes represented by formula (I), the sensitivity does not decrease even if the dyes are incorporated in a comparatively high content, in fact, it sometimes increases. It is believed such a result is perhaps caused by the fact that scattering of light is prevented by light absorption at surfaces of silver halide particles where the sensitizing dyes represented by formula (II) are absorbed, while light absorption of the anti-irradiation dyes in a binder in the silver halide emulsion causes a decrease of the sensitivity because they largely color the binder in the silver halide emulsion.

Another characteristic of the present invention is that the use of the combination of sensitizing dyes causes less residual color to result from the dyes and high sensitivity to the emission of a fluorescent intensifying screen in combination with a spectral sensitivity distribution which is sufficiently safe to light from a safe light filter for X-ray photogrpahic materials (No. 7 Filter produced by Fuji Photo Film Co., Ltd.).

The low degree of cross-over which is one object of the present invention is particularly obtained in the case where both $R_3$ and $R_4$ in the sensitizing dyes represented by formula (II) are a sulfoalkyl group.

In the present invention, each sensitizing dye represented by formula (I) can be used in a desired amount. It is preferred to use each dye in an amount of from about $1.0\times10^{-5}$ to about $1.0\times10^{-3}$ mols of the sensitizing dye per gram mol of silver halide. It is particularly advantageous to use each dye in an amount of from about $4\times10^{-5}$ to $1.6\times10^{-4}$ mols of the sensitizing dye per gram mol of silver halide.

A preferred ratio of the dyes used (molar ratio of the dye(s) represented by formula (I)/the dye(s) represented by formula (II) is from about 1/1 to about 1/10, more preferably from 1/4 to 1/10.

The optimum concentration of the sensitizing dyes in the emulsion can be decided by a method which comprises dividing the emulsion into a number of portions, adding the sensitizing dyes to each portion so as to provide different concentrations and determining the sensitivity of each portion.

The addition of the sensitizing dyes to the emulsion can be carried out by methods known in this art. For example, the sensitizing dyes may be directly dispersed in the emulsion, or they may be added to the emulsion as a solution obtained by dissolving them in a water soluble solvent such as pyridine, methyl alcohol, ethyl alcohol, methyl cellosolve or acetone (or a mixture of two or more of them) and sometimes by further diluting with water, or by dissolving them in only water. Further, ultrasonic vibrations can be used for dissolution. In addition, the processes described in Japanese Patent Publications Nos. 8,231/70, 23,389/69, 27,555/69 and 22,948/69, German Patent Application (OLS) No. 1,947,935 and U.S. Pat. Nos. 3,485,634, 3,342,605 and 2,912,343, etc., can be used.

It is possible to utilize, if desired, a process which comprises dissolving the sensitizing dyes in a suitable solvent, respectively, and adding the resultant solutions to an emulsion or a process which comprises dissolving the sensitizing dyes in identical or different solvents, respectively, and mixing the resultant solutions prior to adding them to the silver halide emulsion. It is necessary that the sensitizing dyes be uniformly dispersed in the emulsion prior to application thereof to a suitable support such as a glass plate, a film of cellulose derivatives, a film of polyvinyl resin (for example, a polystyrene film or a polyvinyl chloride film, etc.), a polyester film, synthetic paper, baryta paper, polyolefin coated photographic paper, etc. Although addition of the sensitizing dyes to the emulsion may be carried out at any step of production of the emulsion, it is convenient to add them after the conclusion of second ageing.

Any kind of silver halide, for example, silver chloride, silver bromide, silver iodide, silver bromochloride, silver bromoiodide or silver iodobromochloride, etc., may be used for producing the emulsion in the present invention. However, silver iodobromide and silver iodobromochloride are particularly preferred and silver iodobromides containing about 0.5 to 3 mol% iodide are more particularly preferred. The silver halide grains can be formed by known methods, for example, a single jet process, a double jet process or a controlled double jet process.

The photographic emulsions which are described in *The Theory of the Photographic Process* written by C. E. K. Mees, published by Macmillan Co., and *Photographic Chemistry* written by Glafikides, published by Fountain Press Co., can be prepared by various processes known to the art, such as an ammonia process, a neutral process or an acid process, etc. After formation of the silver halide grains, they can be washed with water to remove by-produced water soluble salts. They are then generally chemically aged in the presence of one or more chemical sensitizers. Sometimes, the silver halide grains may be used without removing the by-produced water soluble salts. Such conventional processes have been described in the above described texts.

The average particle size (for example, the number average value measured by the projected area method) of the silver halide grains used is not limited to any particular range. However, it is preferred to be in the range of from about 0.5μ to about 2μ, more preferably from 0.7μ to 1.5μ.

A suitable binder such as gelatin which is generally employed at a concentration in the range of 50 to 120 grams per mol of silver halide is generally used, though this range is non-limitative.

The silver halide photographic emulsions used can be sensitized by chemical sensitization processes, for example, gold sensitization (see U.S. Pat. Nos. 2,540,085, 2,597,876, 2,597,915 and 2,399,083, etc.); sensitization by metal ions of Group VIII, sulfur sensitization (see U.S. Pat. Nos. 1,574,944, 2,278,947, 2,440,206, 2,410,689, 3,189,458 and 3,415,649, etc.); reduction sensitization (see U.S. Pat. Nos. 2,518,698, 2,419,974 and 2,983,610, etc.) or a combination thereof.

The emulsions may contain polyoxyethylene derivatives (see British Pat. No. 981,470, Japanese Patent Publication No. 6,475/56 or U.S. Pat. No. 2,716,062, etc.), polyoxypropylene derivatives, or quaternary ammonium group containing compounds as sensitizing agents.

The silver halide emulsions may contain suitable antifogging agents or stabilizers. For example, there are thiazolium salts, azaindenes, urazols, sulfocatechols, oximes, mercaptotetrazoles, nitron, nitroimidazoles, polyvalent metal salts, thiuronium salts and noble metal salts such as of palladium, platinum or gold, etc.

Further, the silver halide photographic emulsions used in the present invention may contain one or more developing agents such as hydroquinones, catechols, aminophenols, 3-pyrazolidones, ascorbic acid or derivatives thereof, reductones or phenylenediamines, etc. The developing agents may be incorporated in a silver halide emulsion layer and/or another layer in the photographic element. The developing agents can be added by dissolving in a suitable solvent or as a dispersion as described in U.S. Pat. No. 2,592,368 or French Pat. No. 1,505,778.

The silver halide emulsions used may be hardened by means of various organic or inorganic hardening agents (for example, formaldehyde, chromium alum, sodium 1-hydroxy-3,5-dichlorotriazine, glyoxal or dichloroacrolein, etc.).

The silver halide photographic emulsions may contain coating assistants such as saponin, alkylarylsulfonates as described in U.S. Pat. No. 2,600,831 or amphoteric compounds, etc.

The silver halide photographic emulsions may contain antistatic agents, plasticizers, fluorescent whitening agents, development accelerators, anti-air fogging agents, toning agents, color couplers, etc.

Further, they may contain anti-irradiation dyes such as those described in Japanese Patent Publications Nos. 20,389/66, 3,504/68 and 13,168/68, U.S. Pat. Nos. 2,697,037, 3,423,207 and 2,865,752, and British Pat. Nos. 1,030,392 and 1,100,546, etc.

In the present invention, conventional gelatino silver halide emulsions are typically used. However, materials which do not have a harmful influence upon the sensitive silver halide such as albumin, agar-agar, gum arabic, alginic acid, hydrophilic resins such as polyvinyl alcohol or polyvinylpyrrolidone or cellulose derivatives may be used instead of gelatin, if desired.

The combination of the dyes of the present invention may be used together with other sensitizing dyes. Particularly, dyes represented by formula (I) and/or dyes represented by formula (II) and methine dyes having a supersensitization function (for example, monomethinecyanine dyes, carbocyanine dyes or apomerocyanine dyes) can be advantageously used.

After exposure to radiation, the silver halide element of this invention is developed, preferably in a surface layer type developing solution. In this case, high development activity is necessary to carry out rapid development. This is attained by using a high energy developing agent or a developing agent having a super accelerating function and alkalizing the developing solution so as to provide a suitable pH (for example, a pH of 9 to 12).

The developing solution may contain conventional additives such as sodium sulfite, hydroxylamine or derivatives thereof, hardening agents, antifoggants, for example, benzotriazole, 5-nitrobenzimidazole or 5-nitroindazole, halides such as potassium bromide, solvents for silver halide, toning agents, dimethylformamide, dimethyl acetamide or N-methyl-pyrrolidone, etc.

It is also possible to obtain monochromatic radiographic dye images by a color development process as is described in Japanese Patent Application No. 55,730/73. On the other hand, it is possible to carry out a reversal color processing as described in Japanese Patent Publication No. 23,310/65 which comprises first carrying out a black-and-white development using Metol or hydroquinone and then carrying out dye image formation. In the above described processing, it is possible to form a dye image plus a silver image by not bleaching the silver image.

The silver halide sensitive materials for radiography of the present invention can be used for recording not only X-rays but also other non-visible penetrating radiation, e.g., β-rays, γ-rays and fast electrons, e.g., as formed in an electron microscope.

The silver halide light sensitive material for radiography can be placed between separate green emitting intensifying screens by the user prior to expose to X-rays or other radiation activating the intensifying screens.

The present invention will now be illustrated by several examples. However, the present invention is not limited thereto.

EXAMPLE 1

A silver iodobromide emulsion (AgI: AgBr=1.3 mol%: 98.7 mol%; gelatin (g)/$AgNO_3$ (g)=0.4; 0.74 mols of silver salt/kg of emulsion) having a 1.2μ average particle size (number average by projected area; hereafter the same) suitable for X-ray exposure was prepared. 5-Methyl-7-hydroxy-S-triazolo-(1,5-a) pyrimidine (stabilizer) was added in an amount of 500 mg per kg of the emulsion. To portions of the resulted emulsion, sensitizing dyes were added solely or as combinations thereof.

The resultant emulsions were applied to both surfaces of blue tinted polyethylene terephthalate supports having a subbing layer on each side thereof so as to form a silver halide emulsion layer having 3.5 g of silver per square meter.

Figure 2:
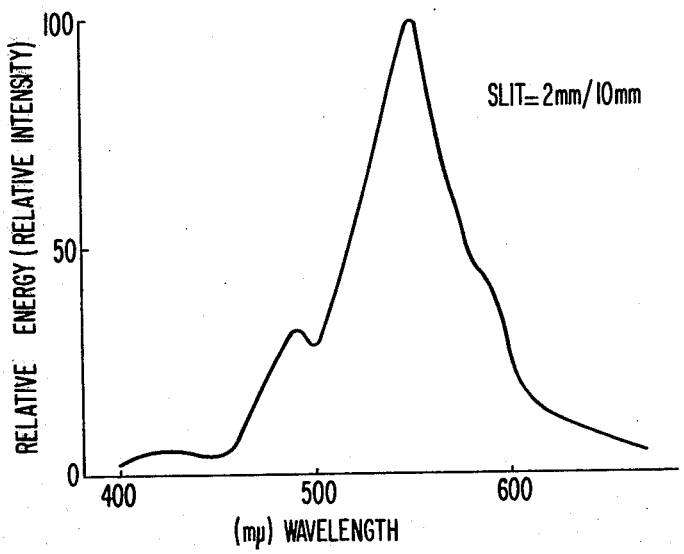
FIG. 2 shows the emission spectral energy distribution emitted by exciting the fluorescent substance in gadolinium oxysulfide fluorescent paper activated by terbium with X-rays.

Onto each emulsion layer, a gelatin protective layer was provided in an amount of 1 g per square meter. The resultant coated film was placed between fluorescent intensifying screens composed of gadolinium oxysulfide ($Gd_2O_2S$) activated by terbium which had an emulsion spectrum as shown in FIG. 2, which was then exposed to X-rays (80 KVp X-ray tube voltage) through a lead square wave test chart to determine the sensitivity and the modulation transfer function (MTF) of the radiographic recording element. After exposure to the X-rays, the radiographic recording element was developed according to the following steps by means of a roller conveying apparatus.

| | Processing Temperature (°C.) | Processing Time (seconds) |
|---|---|---|
| Development | 35 | 25 |
| Fixing | 34 | 25 |
| Water wash | 33 | 25 |
| Drying | 45 | 15 |

The compositions of the developing solution and the fixing solution were as follows.

| Developing solution | |
|---|---|
| Water | 500 ml |
| Hydroxyethylenediamine triacetic acid | 0.8 g |
| Sodium sulfite (anhydrous) | 50.0 g |
| Potassium hydroxide | 20.0 g |
| Hydroquinone | 25.0 g |
| 1-Phenyl-3-pyrazolidone | 1.5 g |
| Boric acid | 10.0 g |
| Triethylene glycol | 25.0 g |
| Glutaraldehyde | 5.0 g |
| Glacial acetic acid | 3.0 g |
| Sodium bisulfite (anhydrous) | 4.5 g |
| 5-Nitroimidazole | 0.03 g |
| 1-Phenyl-5-mercaptotetrazole | 0.005 g |
| 5-Methylbenzotriazole | 0.005 g |
| Water to make | 1.0 l |

(This developing solution had about a 10.30 pH value at 20° C.)

| Fixing solution | |
|---|---|
| Water | 500 ml |
| Ammonium thiosulfate | 180 g |
| Sodium thiosulfate (pentahydrate) | 45 g |
| Sodium sulfite (anhydrous) | 18 g |
| Boric acid | 7.5 g |
| Aluminium chloride (hexahydrate) | 20.0 g |
| Nitrilotriacetic acid | 0.3 g |

-continued

| Fixing solution | |
|---|---|
| Tartaric acid | 3.5 g |
| Glacial acetic acid | 18.0 g |
| Sulfuric acid | 1.2 g |
| Water to make | 1.0 l |

(This fixing solution had about a 4.20 pH value at 20° C.)

The resultant relative sensitivity and MTF value are shown in Table 1. The relative sensitivity in each test (No. 1 and No. 2) is shown as a value based on the sensitivity in the case of using the dye represented by formula (I) being 100. the MTF value was that at a 1.5 l/mm spatial frequency. The higher the MTF value is, the more excellent the sharpness is, i.e., cross-over is low.

TABLE 1

| No. | Sensitizing Dye and Amount thereof × $10^{-5}$ Mols/kg of Emulsion: Formula (I) | Formula (II) | Relative Sensitivity | MTF Value |
|---|---|---|---|---|
| 1 | I - 1 (6) | — | 100 | 0.50 |
| | — | II - 6 (30) | 93 | 0.55 |
| | I - 1 (6) | II - 6 (30) | 120 | 0.63 |
| 2 | I - 10 (6) | — | 100 | 0.51 |
| | — | II -2 (35) | 95.5 | 0.53 |
| | I - 10 (6) | II - 2 (30) | 132 | 0.65 |

As is clear from Table 1, a high sensitivity and a high MTF value were obtained using a combination of the sensitizing dyes of the present invention.

EXAMPLE 2

Example 1 was duplicated except for using the dye combinations below. The results are shown in the Table 2 below, with dyes A, B and C being identified after Table 2.

Table

| No. | Sensitizing Dye and Amount thereof × $10^{-5}$ Mols/kg of Emulsion | | Relative Sensitivity | MTF Value | |
|---|---|---|---|---|---|
| 1. | II-2 (30) | | 100 | 0.53 | |
| 2. | II-2 (30) | I-10 (6) | 138 | 0.65 | Present invention |
| 3. | II-2 (30) | A (6) | 100 | 0.54 | for Comparison |
| | " | A (10) | 97.5 | 0.54 | " |
| 4. | II-6 (30) | | 100 | 0.55 | |
| 5. | II-6 (30) | I-1 (6) | 130 | 0.63 | Present invention |
| 6. | II-6 (30) | B (6) | 100 | 0.55 | for Comparison |
| | " | B (10) | 95 | 0.55 | " |
| 7. | II-4 (30) | | 100 | 0.52 | |
| 8. | II-4 (30) | I-17 (6) | 130 | 0.63 | Present invention |
| 9. | II-4 (30) | C (6) | 100 | 0.53 | for Comparison |
| | " | (10) | 95 | 0.53 | " |

Sensitizing dyes II-1, II-4, II-6, I-1, I-10 and I-17 are the same as earlier disclosed. The chemical structures of sensitizing dyes A, B, and C are as follows:

A:

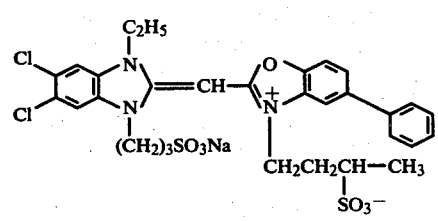

Dye A is similar to Dye II-16 of U.S. Pat. No. 3,953,215 Hinata et al.

B:

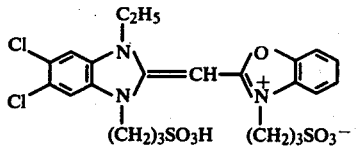

Dye B is similar to Dye II-17 of U.S. Pat. No. 3,953,215 Hinata et al.

C:

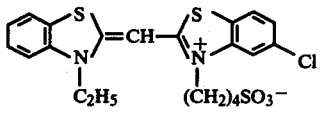

Dye C is similar to Dye II-5 of U.S. Pat. No. 3,953,212 Hinata et al.

From the above Table, it is apparent that high relative sensitivity and high MTF values were obtained using the combination of dyes of the present invention as compared with the dyes of the Hinata et al patent.

While the invention has been described in detail and with reference to specific embodiments thereof, it will be apparent to one skilled in the art that various changes and modifications can be made therein without departing from the spirit and scope thereof.

What is claimed is:

1. A silver halide radiographic sensitive element comprising (1) a silver halide radiographic sensitive material comprising a support having thereon at least one silver halide photographic emulsion layer containing below about 8.6 g of silver per square meter and containing a combination of at least one dye represented by formula (I) and at least one dye represented by formula (II)

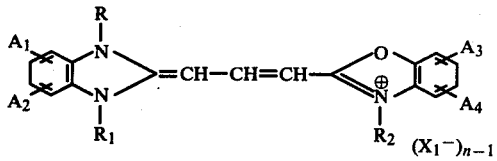

(I)

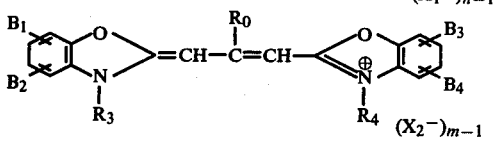

(II)

wherein $A_1$ and $A_2$ each represents a hydrogen atom or a halogen atom; $A_3$ and $A_4$ each represents a hydrogen atom, a halogen atom, an alkoxy group or a phenyl group, $B_1$, $B_2$, $B_3$ and $B_4$ each represents a hydrogen atom, a halogen atom or an alkoxy group; R, $R_1$ and $R_2$ each represents an alkyl group and at least one of $R_1$ and $R_2$ represents a sulfoalkyl group or a carboxylic group; $R_0$ represents a hydrogen atom or a lower alkyl group, $R_3$ and $R_4$ each has the same meaning as $R_1$ and $R_2$; $X_1$ represents an anion; m and n each represents an integer of 1 or 2, but m and n are 1 when the dye froms an inner salt, and $X_2$ represents an anion; and (2) a pair of fluorescent intensifying screens which upon exposure each emits light having a maximum emission in the green spectral range by exitation with radiation wherein at least ½ of the emission energy is in the wavelength range of above about 400 nm; wherein said radiographic sensitive material is separate from said fluorescent intensifying screens and is located between said fluorescent intensifying screens.

* * * * *